US011626218B2

(12) United States Patent
Mikami et al.

(10) Patent No.: US 11,626,218 B2
(45) Date of Patent: Apr. 11, 2023

(54) LAMINATED ALUMINA BOARD FOR ELECTRONIC DEVICE, ELECTRONIC DEVICE, AND CHIP RESISTOR

(71) Applicant: Panasonic Intellectual Property Management Co., Ltd., Osaka (JP)

(72) Inventors: Masateru Mikami, Hyogo (JP); Daisuke Suetsugu, Osaka (JP); Norimichi Noguchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/354,895

(22) Filed: Jun. 22, 2021

(65) Prior Publication Data

US 2022/0028586 A1 Jan. 27, 2022

(30) Foreign Application Priority Data

Jul. 21, 2020 (JP) ..... JP2020-124573
May 11, 2021 (JP) ..... JP2021-080627

(51) Int. Cl.
*H01C 1/01* (2006.01)
*H01C 7/00* (2006.01)

(52) U.S. Cl.
CPC ..... *H01C 1/01* (2013.01); *H01C 7/00* (2013.01)

(58) Field of Classification Search
CPC ..... H01C 1/01; H01C 7/00
See application file for complete search history.

(56) References Cited

U.S. PATENT DOCUMENTS

2022/0030707 A1* 1/2022 Noguchi ..... B32B 18/00

FOREIGN PATENT DOCUMENTS

| | | | | |
|---|---|---|---|---|
| EP | 3053740 | A1 * | 8/2016 | ..... B32B 27/00 |
| JP | 2-177501 | | 7/1990 | |
| JP | 6-325968 | | 11/1994 | |
| JP | 2003017301 | A * | 1/2003 | |
| JP | 4016806 | B2 * | 12/2007 | |
| JP | 2017-168749 | | 9/2017 | |
| JP | 2017-168750 | | 9/2017 | |
| WO | WO2019188584 | * | 10/2019 | |

* cited by examiner

*Primary Examiner* — Kyung S Lee
(74) *Attorney, Agent, or Firm* — Wenderoth, Lind & Ponack, L.L.P.

(57) ABSTRACT

The laminated alumina board for an electronic device includes an alumina board that is made of a sintered body of alumina particles and has an unevenness structure that is formed of the alumina particles on a surface and a flattening film that is provided on an upper surface of the alumina board and contains alumina as a main component.

4 Claims, 3 Drawing Sheets

FIG. 4

(Table 1)

| Item | Flattening film | | | | Evaluation of adhesion (thermal load) | Evaluation of adhesion (dicing treatment) | Evaluation of antistatic characteristic |
|---|---|---|---|---|---|---|---|
| | Material | Shape of raw material | Maximum height Rz (nm) | Average spacing S between local peaks (nm) | | | |
| Example 1 | Alumina | Feather shape | 240 | 210 | A | A | B |
| Example 2 | Alumina | Feather shape | 330 | 250 | A | A | B |
| Example 3 | Alumina | Fiber shape | 600 | 360 | B | B | B |
| Example 4 | Alumina | Particle shape | 1650 | 310 | B | B | C |
| Example 5 | Alumina | Feather shape | 240 | 210 | A | A | B |
| Comparative example 1 | Silica | Particle shape | 1150 | 350 | D | B | — |
| Comparative example 2 | Slica | Particle shape | 1400 | 625 | D | D | — |
| Comparative example 3 | Siloxane | Solution | 60 | 2500 | — | D | — |

LAMINATED ALUMINA BOARD FOR ELECTRONIC DEVICE, ELECTRONIC DEVICE, AND CHIP RESISTOR

BACKGROUND

1. Technical Field

The present disclosure relates to a laminated alumina board for an electronic device, an electronic device, and a chip resistor.

2. Description of the Related Art

Alumina boards have a favorable insulation property and a favorable thermal conductive property and thus have been often used as boards in electronic devices, for example, chip resistors in the related art. Ordinarily, a chip resistor includes an insulating board, a pair of upper electrodes provided on both ends of an upper surface of this insulating board, and a resistance element provided on the upper surface of the insulating board and connected between the pair of upper electrodes.

The chip resistor further includes a protective film provided so as to cover at least the resistance element, a pair of end surface electrodes provided on both end surfaces of the insulating board so as to be electrically connected to the pair of upper electrodes, and a plating layer formed on a part of the upper electrodes and the surfaces of the pair of end surface electrodes.

Usually, in the case of manufacturing the chip resistor, a plurality of sets of surface electrodes or resistance elements is collectively formed on a large board made of alumina, and the large board, on which the surface electrodes or the like are formed, is partitioned (broken) along primary partition grooves and secondary partition grooves that extend in a grid shape or cut in a grid shape using a dicing blade in place of the partition grooves, thereby obtaining individual chip elements.

Incidentally, the surface of an alumina board has a fine unevenness or undulation and is not flat. Therefore, there has been a problem in that the shape of a surface electrode or resistance element that is formed on the surface of the alumina board is unlikely to be stable. Particularly, in the case of forming the surface electrode or resistance element as a thin film by photolithography, there has been a problem in that the surface electrode or resistance element, which is a thin film, is affected by the surface state of the alumina board and distortion, disconnection, cracks, or the like occurs.

In order to solve the above-described problem, for example, Japanese Patent Unexamined Publication No. 2017-168749 proposes a technique in which a small amount of silica glass is contained in an alumina board, a glass coating is formed on the entire surface of the alumina board, and an upper electrode, a resistance element, or the like is formed on the glass coating.

SUMMARY

A laminated alumina board for an electronic device according to an exemplary embodiment of the present disclosure includes an alumina board that is made of a sintered body of alumina particles and has an unevenness on a surface, and a flattening film that is provided on an upper surface of the alumina board and contains alumina as a main component.

BRIEF DESCRIPTION OF THE DRAWINGS

FIG. 4 is a view showing the measurement results of the surface textures of resistance elements and the characteristic evaluation results of samples.

DETAILED DESCRIPTION

Figure 1:
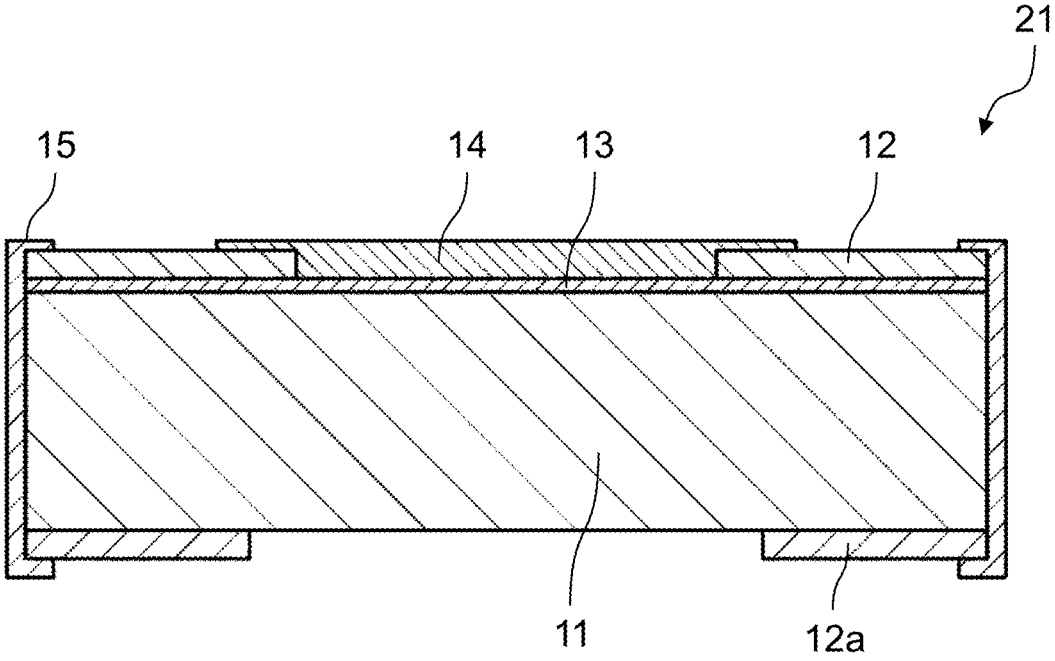
FIG. 1 is a schematic cross-sectional view of a chip resistor according to one exemplary embodiment of the present disclosure.

In the technique of Japanese Patent Unexamined Publication No. 2017-168749, a problem of the disconnection or the like of the resistance element in a chip resistor was caused, and the resistance value varied. As a result, there was a problem in that the yield of the chip resistor decreased. The reason therefor is considered that, in a manufacturing step of the chip resistor, the glass coating peeled off from the alumina board or cracks were generated in the glass coating due to a large difference in the coefficient of thermal expansion between the glass coating, which was a layer below the resistance element, and the alumina board when an annealing treatment was carried out or a thermal load was repeatedly applied after the formation of the resistance element.

The present disclosure has been made in view of the above-described circumstances, and an object of the present disclosure is to provide an electronic device such as a chip resistor that has excellent heat resistance and exhibits stable characteristics even after the above-described annealing treatment or the like and a laminated alumina board that is used for the electronic device.

Therefore, the present inventors carried out intensive studies in consideration of these circumstances and consequently found that a board in the electronic device such as a chip resistor is preferably a laminated alumina board including an alumina board that is made of a sintered body of alumina particles and has an unevenness on a surface, and a flattening film that is provided on an upper surface of the alumina board and contains alumina as a main component.

According to the exemplary embodiment of the present disclosure, it is possible to provide an electronic device such as a chip resistor having excellent heat resistance, and a laminated alumina board that is used for the electronic device.

Hereinafter, first, the laminated alumina board for an electronic device in the exemplary embodiment of the present disclosure will be described. Hereinafter, the laminated alumina board for an electronic device will be simply referred to as "laminated alumina board" in some cases.

Laminated Alumina Board for Electronic Device

Alumina Board

The alumina board that is used in the laminated alumina board for an electronic device is made of a sintered body of alumina particles. The sintered body is preferably formed of alumina that is excellent in terms of heat resistance and an insulation property and has a purity of 96% or higher. Furthermore, the alumina board has an unevenness on the surface. The unevenness on the surface of the alumina board is attributed to the shapes of the alumina particles that configure the sintered body, and the height of the unevenness is, for example, approximately several hundred nanometers to several thousand nanometers. In the exemplary embodiment of the present disclosure, the flattening film provided on the alumina board makes it possible to form, for example, an upper electrode or a resistance element without being affected by the surface state of the alumina board.

Flattening Film

The flattening film contains alumina as a main component. "Main component" means that the proportion of alumina in the flattening film is 50% by mass or more, preferably 80% by mass or more, and more preferably 90% by mass or more. The flattening film may also contain, for example, a metal oxide such as silica, zirconia, or titania, an organic or inorganic binder, or the like in addition to the above-described alumina to an extent that the difference in the coefficient of thermal expansion from the alumina board does not become too large.

Because the main component of the flattening film is alumina, the difference in the coefficient of thermal expansion from the alumina board is unlikely to be caused even when the flattening film receives a thermal load at the time of being provided on the alumina board. Furthermore, because the flattening film containing alumina as the main component is similar to the alumina board in material, the flattening film exhibits an insulation property and a thermal conductive property that are as excellent as those of the alumina board. As a result, it is possible to sufficiently exhibit the characteristics of the alumina board such as the excellent insulation property and the excellent thermal conductive property in electronic devices.

As described above, on the surface of an ordinary alumina board, there is an unevenness of several hundred nanometers to several thousand nanometers attributed to the shapes of the alumina particles that configure the sintered body. Therefore, the film thickness of the flattening film is preferably higher than or equal to the height of the unevenness. Because the height of the unevenness can also be the particle sizes of the alumina particles that configure the sintered body, the film thickness of the flattening film can be said to be preferably set to, for example, larger than or equal to the average particle size of the alumina particles that configure the sintered body. The thickness of the flattening film also depends on the height of the unevenness and the average particle size of the alumina particles that configure the sintered body, but is preferably, for example, 1.0 μm or more. The upper limit of the thickness of the flattening film is not particularly limited, but the thickness of the flattening film can be set to, for example, 20 μm or less.

Maximum Height Rz of Flattening Film

In the case of manufacturing, for example, a chip resistor as an electronic device, a resistance element is provided on the flattening film. In this case, it is desirably that the resistance element firmly adheres to the surface of the flattening film. As a result of studying the adhesion between the flattening film and the resistance element, it was found that the surface of the flattening film preferably has an appropriate roughness. Specifically, it was found that maximum height Rz of the flattening film is preferably 100 nm or more and 1500 nm or less. Maximum height Rz is more preferably 200 nm or more and still more preferably 1000 nm or less. Maximum height Rz is obtained as the maximum height roughness of a roughness curve based on the Japanese Industrial Standards JIS B 0601: 2013.

The reason that the above-described range is preferred will be described by taking a chip resistor as an example. In a case where maximum height Rz is within the above-described range, the resistance element enters the macroscopic uneven structure on the surface of the flattening film, which increases the mutual contact area to develop an anchoring effect and to improve the adhesion between the flattening film and the resistance element.

When maximum height Rz is below 100 nm, because the fine unevenness on the surface of the flattening film is small, the contact between the flattening film and the resistance element remains within a two-dimensional plane range, and the resistance element is likely to peel off from the flattening film. On the other hand, when maximum height Rz of the flattening film exceeds 1500 nm, the surface roughness of the flattening film is large, the role of flattening the alumina board is not sufficiently fulfilled, breakage or poor connection occurs in wires during the formation of the resistance element, and a variation in the resistance value increases.

Average Spacing S Between Local Peaks of Flattening Film

In the fine unevenness present on the surface of the flattening film, when average spacing S between local peaks in the plane is preferably 500 nm or less, the adhesion between the flattening film and the resistance element further improves. Average spacing S between the local peaks is more preferably 300 nm or less. Average spacing S between the local peaks is obtained based on JIS B 0601: 1994.

When average spacing S between the local peaks is 500 nm or less, the resistance element enters the microscopic uneven structure on the surface of the flattening film, which increases the mutual contact area to develop an anchoring effect and to improve the adhesion between the flattening film and the resistance element.

It is preferable that any one of maximum height Rz and average spacing S between the local peaks is within the corresponding range described above because the adhesion between the resistance element and the flattening film improves. As a result, even in the case of carrying out dicing at the time of manufacturing a chip element as described above, the peeling or the like of the resistance element due to the impact of the dicing is suppressed, which makes it possible to maintain favorable adhesion. It is more preferable that both maximum height Rz and average spacing S between the local peaks are within the corresponding ranges described above because the adhesion more firmly improves, and it is possible to further improve durability against a thermal load and durability against the impact of the dicing.

Electronic Device

The exemplary embodiment of the present disclosure includes an electronic device including the laminated alumina board. As the electronic device, a chip resistor is an exemplary example. As the chip resistor, a chip resistor in which at least a resistance element is disposed on the upper surface of the flattening film of the laminated alumina board is an exemplary example.

A method for manufacturing a chip resistor according to one preferred exemplary embodiment of the present disclosure includes a step in which a sol material of feather-shaped or fibrous colloidal alumina particles is applied onto the alumina board by a sol-gel method and dried, and then an annealing treatment is carried out.

Hereinafter, a chip resistor including the laminated alumina board according to the exemplary embodiment of the present disclosure will be described with reference to the drawings. The exemplary embodiment of the present disclosure is not limited to a form shown in the following drawings and can be appropriately changed as long as the effect of the present disclosure is not impaired. In the following description, the same components will be given the same reference sign and will not be described as appropriate.

First, the chip resistor including the laminated alumina board in one exemplary embodiment of the present disclosure will be described with reference to FIG. 1. Chip resistor 21 in one exemplary embodiment of the present disclosure has a configuration shown in FIG. 1. That is, chip resistor 21 is configured to include alumina board 11, a pair of upper electrodes 12, a pair of lower electrodes 12*a*, flattening film 13, resistance element 14, and a pair of end surface electrodes 15. The pair of upper electrodes 12 are provided at both ends of one surface (upper surface) of the alumina board 11. In addition, as shown in FIG. 1, the pair of lower electrodes 12*a* may be provided at both ends of a back surface of alumina board 11. Flattening film 13 is provided on the entire upper surface of alumina board 11, and resistance element 14 is provided on the upper surface of flattening film 13 and is connected between the pair of upper electrodes 12. The pair of end surface electrodes 15 are provided at both end surfaces of alumina board 11 so as to be electrically connected to the pair of upper electrodes 12. Chip resistor 21 exemplified in FIG. 1 is provided with lower electrodes 12*a*, but the chip resistor according to the present disclosure may not be provided with lower electrodes 12*a*.

In the above-described configuration, the shape of alumina board 11 is a rectangular shape (rectangular shape when viewed from above).

A method for manufacturing alumina board 11 is not particularly limited. Ordinarily, alumina board 11 is produced by molding and sintering alumina particles. Alumina particles that are used for the manufacturing of a sintered body that configures alumina board 11 preferably has, for example, a feather shape having a larger aspect ratio than a spherical shape from the viewpoint of enhancing the characteristics of the alumina board.

A method for providing flattening film 13 on alumina board 11 is also not particularly limited. For example, a sol-gel method can be used. The sol-gel method is one of the ceramic synthesis methods and enables the production of the flattening film at low temperatures compared with a conventional melting method and sintering method. In addition, because a raw material in a solution state is used, it is possible to produce a flattening film having a thin film thickness.

In the sol-gel method, flattening film 13 can be formed by applying a sol material onto alumina board 11 and drying the sol material. As a method for the application, a variety of means such as a spin coating method, a clipping method, a spraying method, a transfer coating method, die coating, gravure printing, flexographic printing, offset printing, screen printing, and an inkjet printing method are available.

According to the method represented by the sol-gel method, a leveling effect of a sol-gel liquid is exhibited at the time of forming the flattening film, and it is possible to obtain a flattening film having a flat surface even when the film thickness of the flattening film is almost the same as the unevenness height of the surface of the alumina board.

In order to efficiently develop the leveling effect, it is possible to add an additive, which is intended to control the viscosity by drying, for the purpose of controlling the time taken for the surface of the flattening film to be leveled. In addition, because the leveling can be promoted by decreasing the surface tension, an additive that promotes a decrease in the surface tension may also be added. In addition, the leveling can also be promoted by adding an additive that improves the wettability with the board.

In the above description, the material that configures the flattening film has been described, but the configuration is not limited thereto, and it is also possible to carry out a treatment on the board side. For example, in order to improve the wettability, it is also possible to carry out a hydrophilization treatment, a lipophilization treatment, or the like on the board side depending on the characteristics of the material that configures the flattening film.

As an alumina sol, boehmite crystal, pseudo-boehmite crystal, or non-crystalline colloidal alumina is produced by a variety of methods, and, regarding the shape of the alumina sol, a sol of colloidal alumina particles having a variety of shapes such as a rod shape, a fiber shape, a feather shape, and a granule shape is manufactured. As described above, it is preferable to form flattening film 13 having a film thickness larger than or equal to the unevenness height of the surface of the alumina board.

The shapes of the colloidal alumina particles that are used for the formation of flattening film 13 are preferably a feather shape or a fiber shape and more preferably a feather shape. When colloidal alumina particles having the corresponding shapes are used to form flattening film 13, the colloidal alumina particles entangle each other, an internal stress caused by volume shrinkage can be withstood, and consequently, it is possible to suppress the generation of cracks in flattening film 13 that is caused by drying or sintering.

After the alumina sol is applied and dried on alumina board 11 to form flattening film 13, annealing is preferably carried out. When the above-described annealing is carried out, the crystal structure of the alumina particles changes to decrease the specific surface area of the particles, and a denser film state can be realized. When flattening film 13 is in a dense film state, it is possible to prevent the alumina particles from dropping from the surface of the flattening film, which consequently makes it possible to suppress the surface roughness of flattening film 13 becoming smaller than necessary.

The annealing treatment is carried out after the formation of flattening film 13 and before the formation of resistance element 14 such that resistance element 14 formed on flattening film 13 is not affected by volume shrinkage caused by the annealing. This annealing treatment is preferably carried out at a temperature higher than or equal to a temperature at which an annealing treatment that is carried out in a post step is carried out. For example, the annealing treatment is carried out within a temperature range of 600° C. to 900° C. for, as in examples described below, for example, 12 hours.

After the annealing treatment, for example, as described in the examples described below, a thin film made of an NiCrAlSi alloy is formed on the flattening film by sputtering or the like, subsequently, a pattern is formed by a photolithography method (resist application, drying, exposure, development, etching, and resist peeling) to process the thin film into a meander shape, whereby resistance element 14 can be formed. Examples of a material that configures resistance element 14 include, in addition to the above-described NiCrAlSi alloy, pure metals of each metal of Pt, Ni, and Cu and alloys containing 50% by mass or more of each metal, for example, a Pt—Co alloy. These materials have a large temperature coefficient of resistance (TCR), and resistance elements formed of these materials do not only exhibit a function as a chip resistor but also can be used as a resistance element for temperature measurement.

Methods for forming members other than alumina board 11, flattening film 13, and resistance element 14 in FIG. 1 are also not particularly limited. For example, upper electrodes 12 are formed by printing and firing a thick film material made of copper on flattening film 13. The other electrodes, the protective film, and the plating layer can also be formed as usually formed.

In the manufacturing steps of the chip resistor, an annealing treatment may be carried out after the formation of the resistance element and before the formation of the electrodes or after the formation of the resistance element and the electrodes. According to the exemplary embodiment of the present disclosure, because the laminated alumina board having excellent heat resistance is included, it is possible to prevent the generation of cracks in the resistance element after the annealing treatment.

EXAMPLE

Hereinafter, the present disclosure will be more specifically described using examples. The present disclosure is not limited by the following examples, can also be appropriately modified and then carried out within the scope of the gist described above and to be described below, and such modifications are also all included in the technical scope of the present disclosure.

Example 1

First, a flattening film was produced on an alumina board as follows. A feather-shaped alumina sol (trade name: ALUMINA SOL 200 (AS-200)) manufactured by Nissan Chemical Corporation was treated for 20 seconds, applied onto the upper surface of an alumina board (size: four square inches) formed of alumina having a purity of 96% or higher with a spin coater (manufactured by Mikasa Co., Ltd.) at a rotation speed of 1000 rpm, and dried at room temperature. The film thickness of the flattening film after drying was approximately 4.8 μm. After that, an annealing treatment was carried out at 700° C. for 12 hours in an electric drying furnace.

Figure 2:
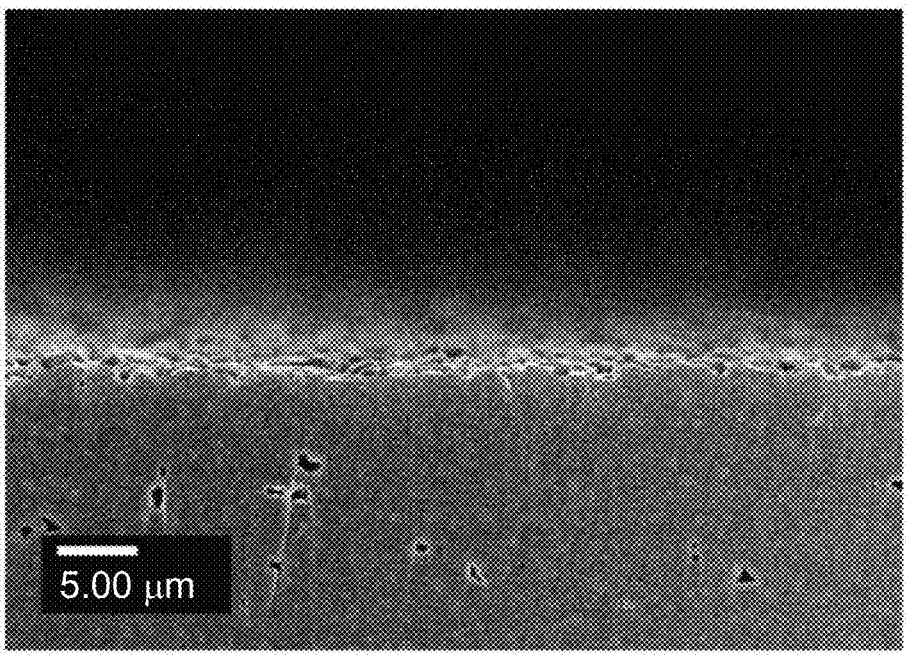
FIG. 2 is a view showing an example of a scanning electron micrograph of a cross section of an alumina board in an example.
Figure 3A:
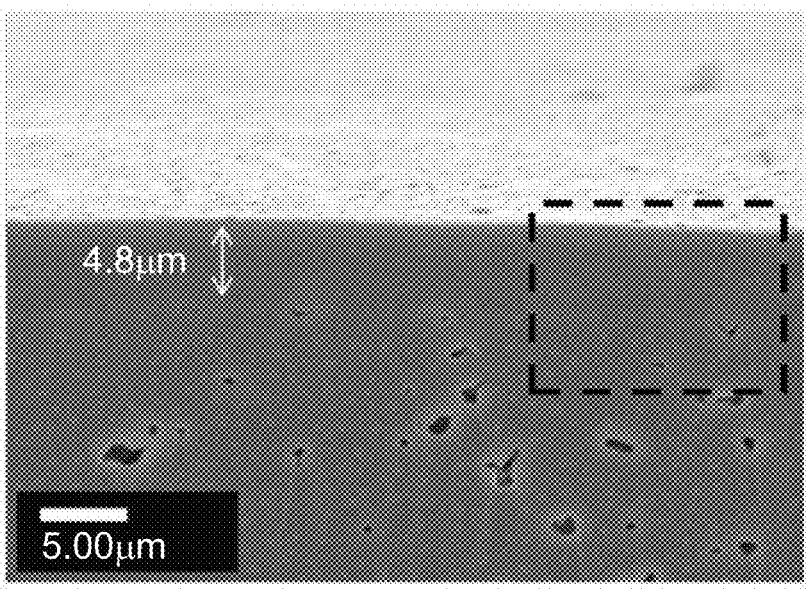
FIG. 3A is a view showing an example of a scanning electron micrograph of the cross section of the alumina board on which a flattening film is formed in the example.
Figure 3B:
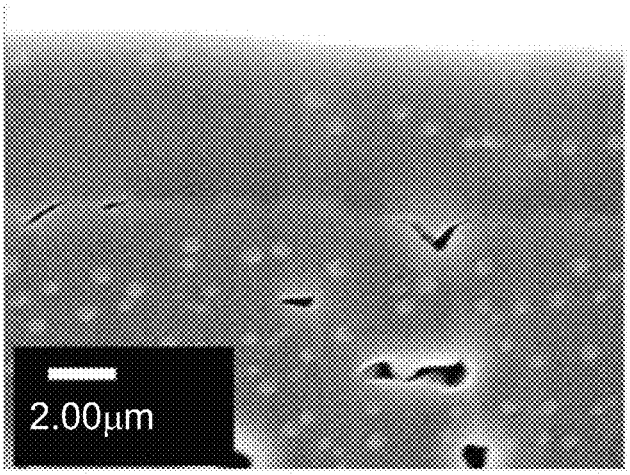
FIG. 3B is an enlarged micrograph of a broken line portion in FIG. 3A.

Examples of the scanning electron micrographs of a cross section of the alumina board used in the present example and the cross section after the formation of the flattening film on the alumina board are shown in FIG. 2, FIG. 3A, and FIG. 3B, respectively. FIG. 2 was captured using a scanning electron microscope (manufactured by Hitachi High-Tech Corporation, S-5000), and FIG. 3A and FIG. 3B were captured using a scanning electron microscope (manufactured by Keyence Corporation, VE-9800). FIG. 3B is an enlarged micrograph of the broken line portion in FIG. 3A.

Maximum height Rz and arithmetic mean roughness Ra of the surface of the alumina board were measured using an atomic force microscope (manufactured by Hitachi High-Tech Science Corporation). As a result, maximum height Rz was 2450 nm, and arithmetic mean roughness Ra was 219 nm. In addition, maximum height Rz, arithmetic mean roughness Ra, and average spacing S between local peaks of the surface of the flattening film after the formation of the flattening film on the alumina board were measured with the atomic force microscope. As a result, maximum height Rz was 240 nm, arithmetic mean roughness Ra was 16.9 nm, and average spacing S between the local peaks was 210 nm. From FIG. 2, FIG. 3A, and FIG. 3B, it is found that the formation of the flattening film makes it possible to obtain a flat surface suitable for the formation of electrodes or resistance elements without being affected by the surface state of the alumina board.

Next, a resistance element was formed on the flattening film as follows. Specifically, a thin film made of an NiCrAlSi alloy was produced on the flattening film by sputtering or the like, and subsequently, a pattern was formed by a photolithography method (resist application, drying, exposure, development, etching, and resist peeling) to process the thin film into a bellows shape having a line width of 15 μm (meander shape), thereby forming a resistance element.

The adhesion between the resistance element and the flattening film after the application of a thermal load was evaluated as the heat resistance using a sample in which the alumina board, the flattening film, and the resistance element were laminated in this order as described below in detail. Furthermore, the adhesion between the resistance element and the flattening film after a dicing treatment and the antistatic characteristic were also evaluated.

Evaluation of Adhesion Between Resistance Element and Flattening Film After Thermal Load As the heat resistance, the adhesion between the resistance element and the flattening film after a heat treatment was evaluated using the sample as follows. First, a thermal load test in which the sample was heated (annealed) at 900° C. was carried out. In addition, the appearances of the surfaces of the resistance element and the flattening film after the test were inspected using an electron microscope, in a case where neither cracking nor film peeling occurred both on the surface of the resistance element and in the flattening film, the adhesion was evaluated as favorable "A", in a case where cracking or film peeling occurred in the flattening film, but did not occur on the surface of the resistance element, the adhesion was evaluated as slightly favorable "B", and in a case where cracking or film peeling occurred in the flattening film and cracking or film peeling also occurred in the resistance element, the adhesion was evaluated as poor "D".

Evaluation of Adhesion Between Resistance Element and Flattening Film After Dicing Treatment After the annealing in the evaluation of the adhesion between the resistance element and the flattening film after the thermal load, an impact resistance test in which an external stress was applied to the resistance element was carried out. In detail, a dicing treatment was carried out to partition the board such that the chip resistor became a 2012 size (2 mm×1.2 mm). In addition, the appearances of the surface of the resistance element and the flattening film after the test were inspected using an electron microscope, in a case where neither cracking nor film peeling occurred both on the surface of the resistance element and in the flattening film, the adhesion was evaluated as favorable "A", in a case where cracking or film peeling occurred in the flattening film, but did not occur on the surface of the resistance element, the adhesion was evaluated as slightly favorable "B", and in a case where cracking or film peeling occurred in the flattening film and cracking or film peeling occurred in the resistance element, the adhesion was evaluated as poor "D".

Evaluation of Antistatic Characteristic

For the present example that was evaluated as favorable in terms of the adhesion between the resistance element and the flattening film after the thermal load and after the dicing treatment, the antistatic characteristic was also evaluated (which was also true in Examples 2 to 4 below). In detail, an electrostatic discharge resistance test (AEC-Q200) was carried out, and in a case where the resistance value change rate was 0.05% or less at the time of applying 1 kV, specimens were evaluated as favorable. The test was carried out on a total of 20 specimens, in a case where the proportion of favorable products was 80% or higher, the antistatic characteristic was evaluated as "B", in a case where the proportion was lower than 80% and 50% or higher, the antistatic characteristic was evaluated as "C", and in a case where the proportion was less than 50%, the antistatic characteristic was evaluated as "D".

Example 2

In Example 2, a flattening film was produced in the same manner as in Example 1 except that the rotation speed of the spin coater was set to 3000 rpm in the formation of the flattening film and a flattening film having a film thickness of 1.8 μm after drying was obtained, and the evaluation was carried out in the same manner.

Example 3

In Example 3, a flattening film was produced in the same manner as in Example 1 except that a fibrous alumina sol (trade name: CATALOID A series (AS-3)) manufactured by JGC Catalysts and Chemicals Ltd. was used to form the flattening film, and the evaluation was carried out in the same manner.

Example 4

In Example 4, a flattening film was produced in the same manner as in Example 1 except that a particulate alumina sol (trade name: Alumina Sol 10-A) manufactured by Kawaken Fine Chemicals Co., Ltd. was used to form the flattening film, and the evaluation was carried out in the same manner.

Comparative Example 1

In Comparative Example 1, a flattening film was produced in the same manner as in Example 1 except that a particulate silica sol (trade name: SI-80P) manufactured by JGC Catalysts and Chemicals Ltd. was used to form the flattening film, and the evaluation was carried out in the same manner.

Comparative Example 2

In Comparative Example 2, a flattening film was produced in the same manner as in Example 1 except that a particulate silica sol (trade name: SS-300) manufactured by JGC Catalysts and Chemicals Ltd. was used to form the flattening film, and the evaluation was carried out in the same manner.

Comparative Example 3

In Comparative Example 3, siloxane (trade name: S05-01811) manufactured by Merck Performance Materials Co., Ltd. was used to form a flattening film. Because siloxane is excellent in terms of flatness at the time of forming films but poor in heat resistance, no annealing treatment was carried out after the siloxane was applied and naturally dried. In addition, the thermal load test was not carried out either. Except for these, a sample was produced and evaluated in the same manner as in Example 1.

The measurement results of the surface textures of the resistance elements and the characteristic evaluation results of the samples are shown together in Table 1 of FIG. 4. Hereinafter, each example of Examples 1 to 4 and Comparative Examples 1 to 3 will be described using Table 1.

As is clear from Table 1, in Examples 1 to 4, because the flattening film was formed of, similar to the alumina board, alumina on the surface of the alumina board having an uneven structure, the adhesion between the resistance element and the flattening film was excellent after the thermal load test of the sample and after the dicing treatment. That is, in Examples 1 to 4, the heat resistance and, furthermore, the impact resistance were excellent.

Furthermore, in these examples, because the flattening film is the same material as the alumina board, it is possible to sufficiently exhibit the excellent thermal conductive property of the alumina board.

Particularly, in Examples 1 to 3, maximum height Rz was within a range of 100 nm to 1500 nm, average spacing S between the local peaks was 500 nm or less, and the adhesion between the resistance element and the flattening film was excellent after the thermal load test of the sample and after the dicing treatment, and the antistatic characteristic was also excellent. Among them, Examples 1 and 2 were particularly excellent in terms of the adhesion between the resistance element and the flattening film after the thermal load test of the sample and the dicing treatment. The reason therefor is considered that average spacing S between the local peaks was sufficiently small and the anchoring effect between the flattening film and the resistance element was sufficiently developed.

In Example 4, maximum height Rz was higher than those in Examples 1 to 3. This is considered to be because the alumina sol material used in Example 4 had a lower viscosity than the alumina sol materials of Examples 1 to 3, which made it easy for the surface of the flattening film to reflect the unevenness of the surface of the alumina board. In Example 4, the adhesion between the resistance element and the flattening film was excellent after the thermal load test of the sample and after the dicing treatment due to the anchoring effect developed by the unevenness of the flattening film, but the variation in the antistatic characteristic became larger than in Examples 1 to 3. The reason therefor is considered that, due to the unevenness of the flattening film, some of wires in the resistance element broke or a defect was partially generated in the wires at the time of energization in the electrostatic discharge resistance test, and thus the resistance value change rate became large.

From the comparison between Examples 1 to 3 and Example 4, it is found that maximum height Rz of the flattening film is preferably 1500 nm or less in order to further enhance the electrostatic discharge resistance.

In Comparative Example 1, the evaluation of the adhesion by a thermal load was confirmed to be poor. This is considered to be because, while the alumina board and the flattening film adhered to each other due to the anchoring effect developed therebetween, because the material of the flattening film was silica, which is different from the material of the alumina board, the application of the thermal load caused an interfacial stress attributed to the difference in the coefficient of thermal expansion, and cracking or the peeling of the film occurred at the interface of the flattening film with the alumina board. In addition, it can be considered that, due to the occurrence of cracking or the peeling of the film in the flattening film, cracking or the peeling of the film also occurred in the resistance element formed on the surface of the flattening film. Maximum height Rz and average spacing S between the local peaks in Comparative Example 1 were within the preferred ranges, and the evaluation of the adhesion by dicing was favorable.

In Comparative Example 2 as well, similar to Comparative Example 1, because the material of the flattening film was silica, which is not alumina that is the same material as the board, the evaluation of the adhesion by a thermal load was confirmed to be poor for the above-described reason. Unlike Comparative Example 1, in Comparative Example 2, it was found that the adhesion between the resistance element and the flattening film was poor even in a case where dicing was carried out without carrying out the heat treatment. The reason therefor is considered that average spacing S between the local peaks was not within the preferred range and a sufficient anchoring effect was not sufficiently developed between the flattening film and the resistance element.

In Comparative Example 3 as well, because the material of the flattening film was siloxane, which is not alumina that is the same material as the board, it was confirmed that the adhesion was evaluated as poor for the same reason as in Comparative Example 1. In addition, similar to Comparative Example 2, it was found that the adhesion between the resistance element and the flattening film was poor even in a case where dicing was carried out without carrying out the heat treatment. This is considered that, because maximum height Rz was below the preferred range and average spacing S between the local peaks exceeded the preferred upper limit, a sufficient anchoring effect was not developed between the flattening film and the resistance element, and cracking or peeling occurred in the resistance element. In a case where maximum height Rz of the flattening film was 100 nm or less as in Comparative Example 3, average spacing S between the local peaks and maximum height Rz appeared to correlate with each other, and average spacing S between the local peaks became a wide spacing of 500 nm or larger.

Example 5

In Example 5, a sample having the same structure as in Example 1 was obtained except that the material that configured the resistance element was Pt and the conditions for the etching, the heat treatment, and the like in the steps were changed accordingly. It was possible to confirm that the configuration of the sample made the heat resistance, which was the intended property, and, furthermore, the impact resistance excellent and also enabled the measurement of temperatures by taking advantage of a large TCR.

The laminated alumina board of the present disclosure is capable of enhancing the adhesion between the alumina board and the flattening film and, furthermore, the adhesion between the flattening film and, for example, a resistance element. Therefore, the laminated alumina board exhibits excellent heat resistance even in the case of repeatedly receiving a thermal load and is thus useful as a board component that is used in electronic devices.

What is claimed is:

1. A laminated alumina board for an electronic device, the laminated alumina board comprising:

an alumina board that is made of a sintered body of alumina particles and has an unevenness on a surface; and a flattening film that is provided on an upper surface of the alumina board and contains alumina as a main component, wherein a maximum height Rz of the flattening film is more than 100 nm and equal to or less than 1500 nm.

2. The laminated alumina board of claim 1, wherein an average spacing S between local peaks of the flattening film is 500 nm or less.

3. An electronic device comprising:

the laminated alumina board of claim 1.

4. A chip resistor, comprising:

the laminated alumina board of claim 1; and a resistance element disposed on an upper surface of the flattening film.

* * * * *